US011897722B2

(12) United States Patent
Ohashi

(10) Patent No.: US 11,897,722 B2
(45) Date of Patent: Feb. 13, 2024

(54) SHEET CONVEYING DEVICE

(71) Applicant: TOSHIBA TEC KABUSHIKI KAISHA, Tokyo (JP)

(72) Inventor: Junya Ohashi, Sunto Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 87 days.

(21) Appl. No.: 17/570,941

(22) Filed: Jan. 7, 2022

(65) Prior Publication Data

US 2022/0356024 A1 Nov. 10, 2022

(30) Foreign Application Priority Data

May 10, 2021 (JP) ..... 2021-079854

(51) Int. Cl.
*B65H 7/12* (2006.01)

(52) U.S. Cl.
CPC ..... *B65H 7/125* (2013.01); *B65H 2553/30* (2013.01); *B65H 2557/61* (2013.01)

(58) Field of Classification Search
CPC ..... B65H 7/125; B65H 2553/30; B65H 2557/61; B65H 2557/63; G01N 29/4427; G01N 29/11; G03G 2215/00548; G03G 2215/00637
See application file for complete search history.

(56) References Cited

U.S. PATENT DOCUMENTS

2012/0269566 A1* 10/2012 Inoue ..... B65H 7/125 400/582
2016/0159597 A1* 6/2016 Hayashi ..... B65H 7/125 271/265.04
2017/0341890 A1* 11/2017 Hayashi ..... B65H 5/06
2019/0248611 A1* 8/2019 Okazaki ..... G01N 29/4427

FOREIGN PATENT DOCUMENTS

JP 2008-254919 A 10/2008
JP 2013-010599 A 1/2013
JP 2014-047075 A 3/2014
JP 2019006520 A * 1/2019

* cited by examiner

*Primary Examiner* — Luis A Gonzalez
(74) *Attorney, Agent, or Firm* — Kim & Stewart LLP

(57) ABSTRACT

According to an embodiment, a sheet conveying device detects double feeding of sheets by an ultrasonic wave oscillator and an ultrasonic waves receiver provided across a conveying path of the sheets. The sheet conveying device calibrates a threshold voltage on the basis of an offset voltage of an amplifier circuit when the receiver has not received ultrasonic waves.

9 Claims, 12 Drawing Sheets

SHEET CONVEYING DEVICE

CROSS-REFERENCE TO RELATED APPLICATIONS

This application is based upon and claims the benefit of priority from the prior Japanese Patent Application No. 2021-079854, filed on May 10, 2021, the entire contents of which are incorporated herein by reference.

FIELD

An embodiment to be described here generally relates to a sheet conveying device.

BACKGROUND

There is a sheet conveying device that conveys a sheet such as paper. The sheet conveying device is used in, for example, a printer, a copying machine, a facsimile machine, or a multifunction device. In the sheet conveying device, so-called double feeding in which a plurality of sheets overlaps with each other and is conveyed, occurs in some cases. The double feeding can cause errors such as jams. In this regard, the sheet conveying device has a double feeding detection function.

As an example of the double feeding detection function, a technology using an ultrasonic sensor has been known. When there is a sheet between an oscillator of the ultrasonic sensor and a receiver, the ultrasonic waves from the oscillator are attenuated and reach the receiver. The amount of attenuation increases as the thickness of the sheet increases. In particular, in the case where double feeding has occurred, the ultrasonic waves are more attenuated due to the influence of the air layer between the sheets. When the ultrasonic waves are attenuated, the output voltage of the receiver decreases. The double feeding detection function compares the output voltage of the receiver with a threshold voltage for determining double feeding, and detects that double feeding has occurred in the case where the output voltage is lower than the threshold voltage.

In general, the ultrasonic sensors have variations in sensitivity. For this reason, even in a sheet conveying device having the same configuration, it is difficult to unambiguously determine the threshold voltage for determining double feeding, and it is necessary to perform so-called calibration. In the existing calibration work, a calibration sheet in which a plurality of sheets are boded to other is disposed between an oscillator and a receiver. It is common to calibrate the threshold voltage on the basis of the level of the output value of the receiver when the oscillator oscillated ultrasonic waves.

However, since such calibration work is inefficient because the oscillator needs to oscillate ultrasonic waves. Further, the work is complicated because it is necessary to prepare a calibration sheet.

DETAILED DESCRIPTION

Figure 1:
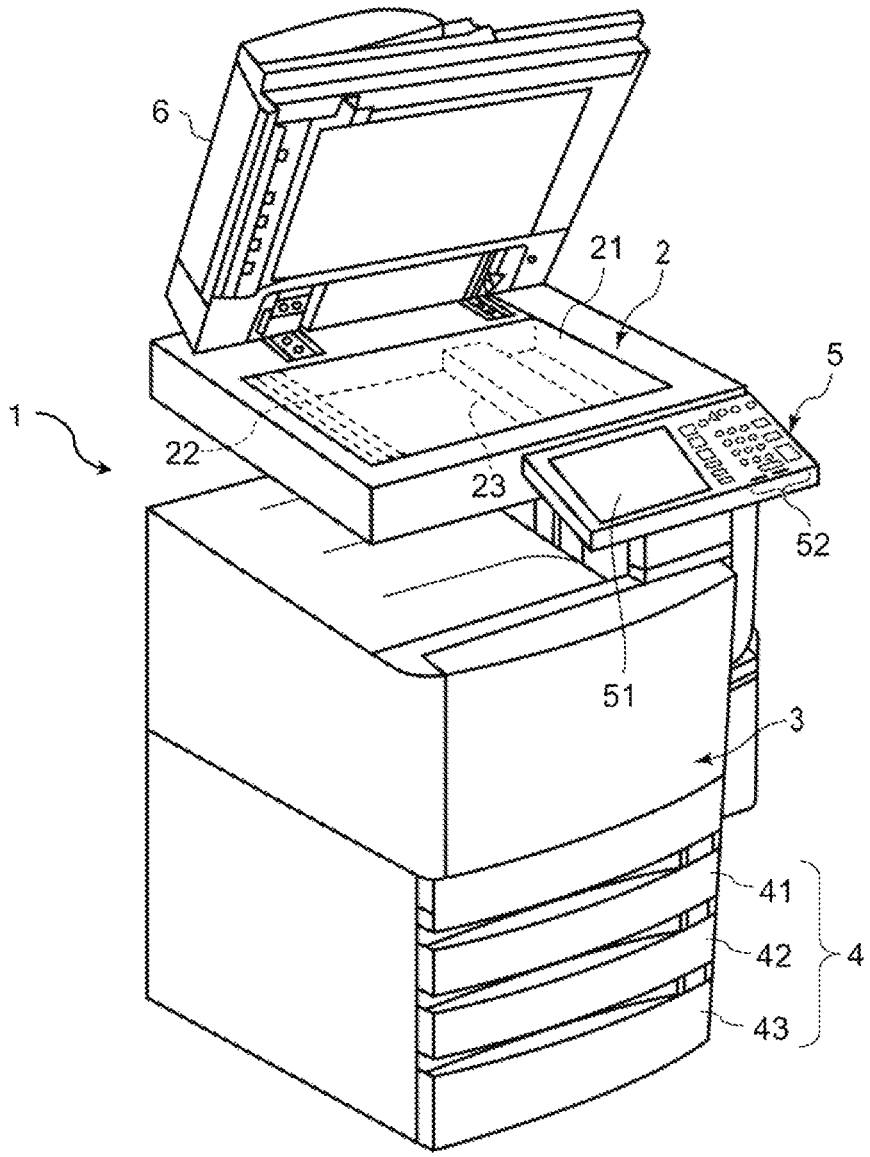
FIG. 1 is a perspective view showing the appearance of an MFP according to an embodiment.

According to an embodiment, a sheet conveying device includes: a conveying device; an oscillator; a receiver; an amplifier circuit; a comparator; and a processor. The conveying device conveys a sheet through a conveying path. The oscillator oscillates ultrasonic waves on the sheet conveyed through the conveying path. The receiver is provided at a position facing the oscillator across the conveying path and receives the ultrasonic waves oscillated from the oscillator. The amplifier circuit amplifies an output signal of the receiver. The comparator compares a voltage of the output signal amplified by the amplifier circuit with a threshold voltage. The processor detects, on the basis of a comparison result of the comparator, double feeding of sheets conveyed through the conveying path. Further, the processor calibrates the threshold voltage on the basis of an offset voltage of the amplifier circuit where the receiver has not received the ultrasonic waves.

An embodiment of a sheet conveying device will be described with reference to the drawings.

This embodiment represents a case where an ADF (Auto Document Feeder) of an image forming apparatus, e.g., an MFP (Multi-Functional Peripheral: a digital multifunction device), is used as an aspect of a sheet conveying device. In the drawings, the same reference symbols indicate the same or similar portions.

[Description of MFP Configuration]

FIG. 1 is a perspective view showing the appearance of an MFP 1. As shown in FIG. 1, the MFP 1 includes a scanner device 2, a printer device 3, a paper cassette device 4, an operation panel 5, and an ADF 6.

The scanner device 2 is located on the upper part of the MFP body including the printer device 3. The scanner device 2 scans a document and optically reads an image of the document. The scanner device 2 includes a document glass 21 for placing a document to be scanned, and an image reading mechanism. The image reading mechanism scans the document placed on the document glass 21 from below the document glass 21 via the glass, and reads the image of the document. The image reading mechanism includes a carriage 22 and a photoelectric conversion device 23. The carriage 22 is equipped with an optical system such as an illumination and a mirror. The illumination is installed on the carriage 22 such that the emitted light illuminates the reading position on the document glass 21 from below the document glass 21. The reading position corresponds to an image for one line or a plurality of lines in the main scanning direction. The optical system such as a mirror is installed on the carriage 22 such that reflected light from the reading position illuminated by the illumination is guided to the photoelectric conversion device 23.

The carriage 22 moves below the document glass 21 in the sub-scanning direction by a moving mechanism 24 (FIG. 5) including a stepping motor or the like. the carriage 22 moves in the sub-scanning direction to continuously guide an image for each line in the main scanning direction in the region on the document glass 21 on which a document is to be placed, i.e., the document reading region, to the photoelectric conversion device 23.

The photoelectric conversion device 23 includes a lens, a photoelectric conversion sensor, and the like. The lens collects light guided by the optical system of the carriage 22 and guides the collected light to the photoelectric conversion sensor. The photoelectric conversion sensor is, for example, a line sensor in which photoelectric conversion elements such as CCD or CIS are arranged in a line. The photoelectric conversion sensor converts the image for one line in the main scanning direction into pixel data for one line.

The printer device 3 outputs image information as an output image called, for example, a hard copy or a printout. Details of the printer device 3 will be described below with reference to FIG. 2.

The paper cassette device 4 is located on the lower part of the MFP body. The paper cassette device 4 supplies, to the printer device 3, the sheet to be used for image output. The sheet is generally paper of an arbitrary size such as "A3", "B4", "A4", and "B5". The paper cassette device 4 includes a first paper cassette 41, a second paper cassette 42, and a third paper cassette 43. The first paper cassette 41, the second paper cassette 42, and the third paper cassette 43 each houses a sheet of one type of size.

The operation panel 5 is a user interface. The operation panel 5 displays guidance and accepts an input of an operation button or an icon. The user is not limited to a user of the MFP 1. The user includes, for example, an administrator of the MFP 1, a service person, and the like. The operation panel 5 includes a touch panel 51 and a plurality of operation buttons 52. The touch panel 51 serves as both an input device and a display device of the MFP 1. The touch panel 51 includes a touch sensor disposed on the screen of the display. The display displays various images including icons, texts, or the like. The touch sensor detects the position on the screen touched by the user. The operation button 52 includes, a power button, a mode selection button, a numeric key button, a clear button, and the like.

The ADF 6 is connected to the scanner device 2. Details of the ADF 6 will be described below with reference to FIG. 3 and FIG. 4.

Figure 2:
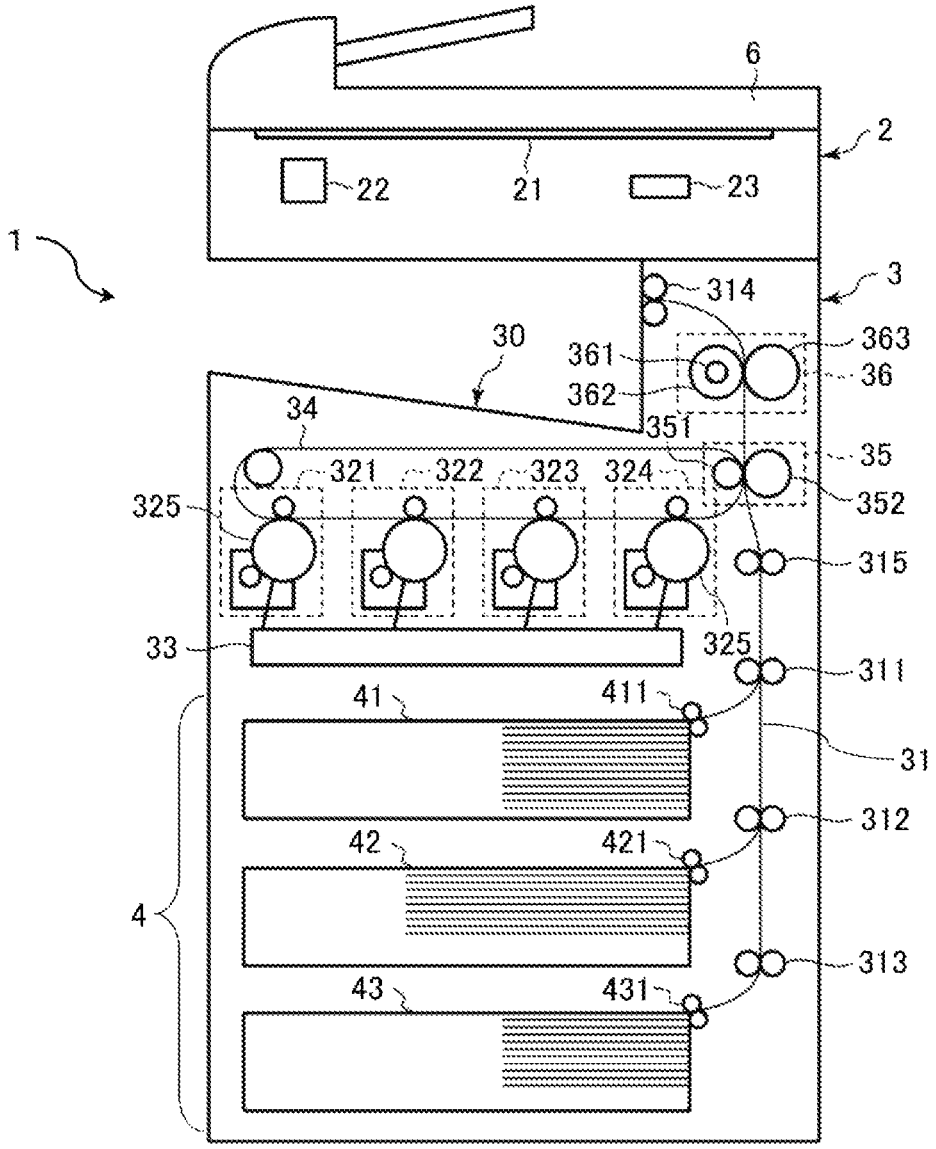
FIG. 2 is a cross-sectional view schematically showing the internal configuration of the MFP according to the embodiment.

FIG. 2 is a cross-sectional view schematically showing the internal configuration of the MFP 1. As shown in FIG. 2, the first paper cassette 41, the second paper cassette 42, and the third paper cassette 43 in the paper cassette device 4 respectively include paper feed rollers 411, 421, and 431. The paper feed rollers 411, 421, and 431 respectively take out one sheet at a time from the first to third paper cassettes 41, 42, and 43. Each of the sheets taken out from the first to third paper cassettes 41, 42, and 43 is conveyed to the printer device 3 by a conveying device 31.

The conveying device 31 conveys a sheet in the MFP body. The conveying device 31 includes a plurality of conveying rollers 311, 312, 313, and 314 and a resist roller 315 provided along the conveying path, and the like. Further, the conveying device 31 includes a motor for driving each of the conveying rollers 311, 312, 313, and 314 and the resist roller 315. The conveying device 31 conveys, to the resist roller 315, the sheet taken out by one of the paper feed rollers 411, 421, and 431. The resist roller 315 conveys the sheet to a transfer position at the timing of transferring an image.

The printer device 3 includes a plurality of image forming devices 321, 322, 323, and 324, an exposure device 33, an intermediate transfer belt 34, a transfer device 35, and a fixing device 36.

Each of the image forming devices 321, 322, 323, and 324 includes an image carrier 325. The exposure device 33 forms an electrostatic latent image on each image carrier 325 by performing scanning on the image carrier 325 of the corresponding image forming device 321, 322, 323, or 324 with light emitted in accordance with image data. Each of the image forming devices 321, 322, 323, and 324 develops an electrostatic latent image on each image carrier 325 using, for example, toners of respective colors of yellow, magenta, cyan, and black to form a toner image on the corresponding image carrier 325.

The intermediate transfer belt 34 is an intermediate transfer body. Each of the image forming devices 321, 322, 323, and 324 superimposes and transfers the toner image of the respective colors formed of toners of the respective colors by the corresponding image carrier 325 on the intermediate transfer belt 34 from the corresponding image carrier 325. This transfer is called primary transfer. The intermediate transfer belt 34 holds the transferred toner image and conveys it to a second transfer position.

The secondary transfer position is a position where the toner image on the intermediate transfer belt 34 is transferred to a sheet. The transfer device 35 is provided at the secondary transfer position. The transfer device 35 includes a support roller 351 and a secondary transfer roller 352. The secondary transfer position is a position where the support roller 351 and the secondary transfer roller 352 face each other. The resist roller 315 conveys the sheet to the secondary transfer position in accordance with the timing of the toner image on the intermediate transfer belt 34. The transfer device 35 transfers the toner image held on the intermediate transfer belt 34 to the sheet at the secondary transfer position.

The conveying device 31 conveys, to a fixing position, the sheet on which the toner image has been transferred at the secondary transfer position. The fixing device 36 is provided at the fixing position. The fixing device 36 includes a heating unit 361, a heat roller 362, and a pressure roller 363. The fixing position is a position where the heat roller 362 and the pressure roller 363 face each other.

The heating unit 361 heats the heat roller 362. The heat roller 362 and the pressure roller 363 perform fixing processing of heating, in a pressurized state, the sheet on which the toner image has been transferred by the transfer device 35. The fixing device 36 fixes the toner image to the sheet by the fixing processing. The heat roller 362 and the pressure roller 363 convey, to the conveying roller 314, the sheet on which the fixing processing has been performed. The conveying roller 314 discharges, to a discharge tray 30, the sheet to which the toner image has been fixed by the fixing device 36.

[Description of ADF Configuration]

Figure 3:
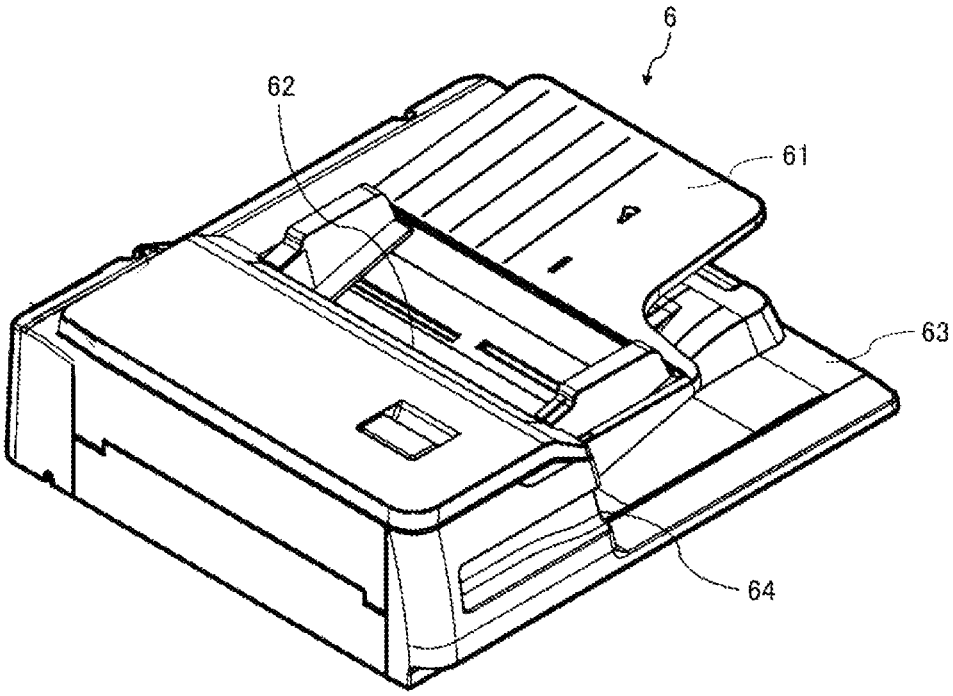
FIG. 3 is a perspective view of an ADF of the MFP according to the embodiment.
Figure 4:
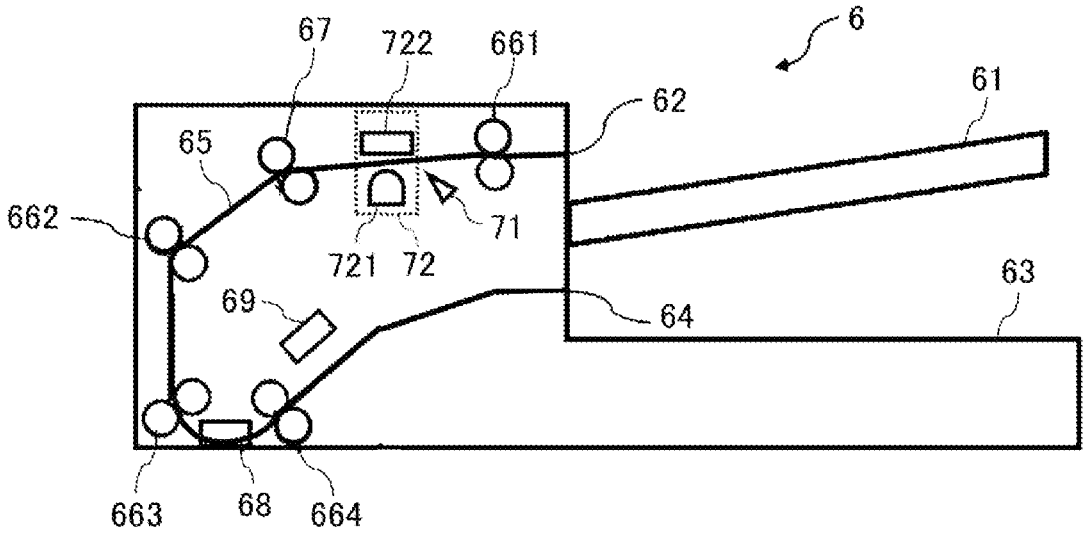
FIG. 4 is a cross-sectional view schematically showing the ADF according to the embodiment.

FIG. 3 is a perspective view showing the ADF 6. FIG. 4 schematically shows the cross section of the ADF 6. The ADF 6 includes a paper feed unit 62 that feeds a sheet of a document placed on a paper feed tray 61, and a paper discharge unit 64 that discharges, to the discharge tray 63, the sheet conveyed in the ADF 6.

The ADF 6 includes a conveying path 65 for guiding, to the paper discharge unit 64, the sheet fed by the paper feed unit 62. The ADF 6 includes a plurality of conveying rollers 661, 662, 663, and 664 and a resist roller 67 disposed along the conveying path 65. Each of the conveying rollers 661, 662, 663, and 664 is disposed at the corresponding position so that a sheet can be conveyed from the paper feed unit 62 to the paper discharge unit 64 through the conveying path 65 including the paper feed unit 62 of the ADF 6 as a conveying start position and the paper discharge unit 64 as a conveying end position. The resist roller 67 temporarily stops the sheet that is being conveyed, and conveys the sheet to the downstream side at an arbitrary timing.

The ADF 6 is a DSDF (Dual Scan Document Feeder). That is, the ADF 6 includes a slit 68 at a position of the conveying path 65 facing the scanner device 2. The ADF 6 conveys the sheet fed from the paper feed unit 62 such that the sheet is seen through the slit 68. The scanner device 2 reads, through the slit 68, an image of a first surface of the sheet conveyed through the conveying path 65. The ADF 6 includes a scanner 69 on the downstream side of the slit 68 of the conveying path 65. The scanner 69 reads an image of a second surface opposite to the first surface of the sheet conveyed through the conveying path 65.

The ADF 6 includes a paper feed sensor 71 and a double feeding sensor 72 in the vicinity of the paper feed unit 62 in the conveying path 65. Specifically, in the ADF 6, the paper feed sensor 71 and the double feeding sensor 72 are disposed between the conveying roller 661 and the resist roller 67 disposed along the conveying path 65. The paper feed sensor 71 is a sensor for detecting the sheet fed from the paper feed unit 62. As the paper feed sensor 71, for example, a reflection-type or transmission type optical sensor is used. The double feeding sensor 72 is a sensor for detecting double feeding in which a plurality of sheets overlaps with each other and is conveyed. As the double feeding sensor 72, an ultrasonic sensor is used. That is, the double feeding sensor 72 includes an oscillator 721 that oscillates ultrasonic waves and a receiver 722 that receives the ultrasonic waves oscillated from the oscillator 721. The oscillator 721 and the receiver 722 of the double feeding sensor 72 are disposed at positions facing each other across the conveying path 65. Note that the disposition relationship between the oscillator 721 and the receiver 722 is not limited to the disposition shown in FIG. 4. Although the oscillator 721 is disposed on the lower side of the conveying path 65 and the receiver 722 is disposed on the upper side in FIG. 4, the upper and lower positions may be reversed.

[Description of MFP Circuit]

Figure 5:
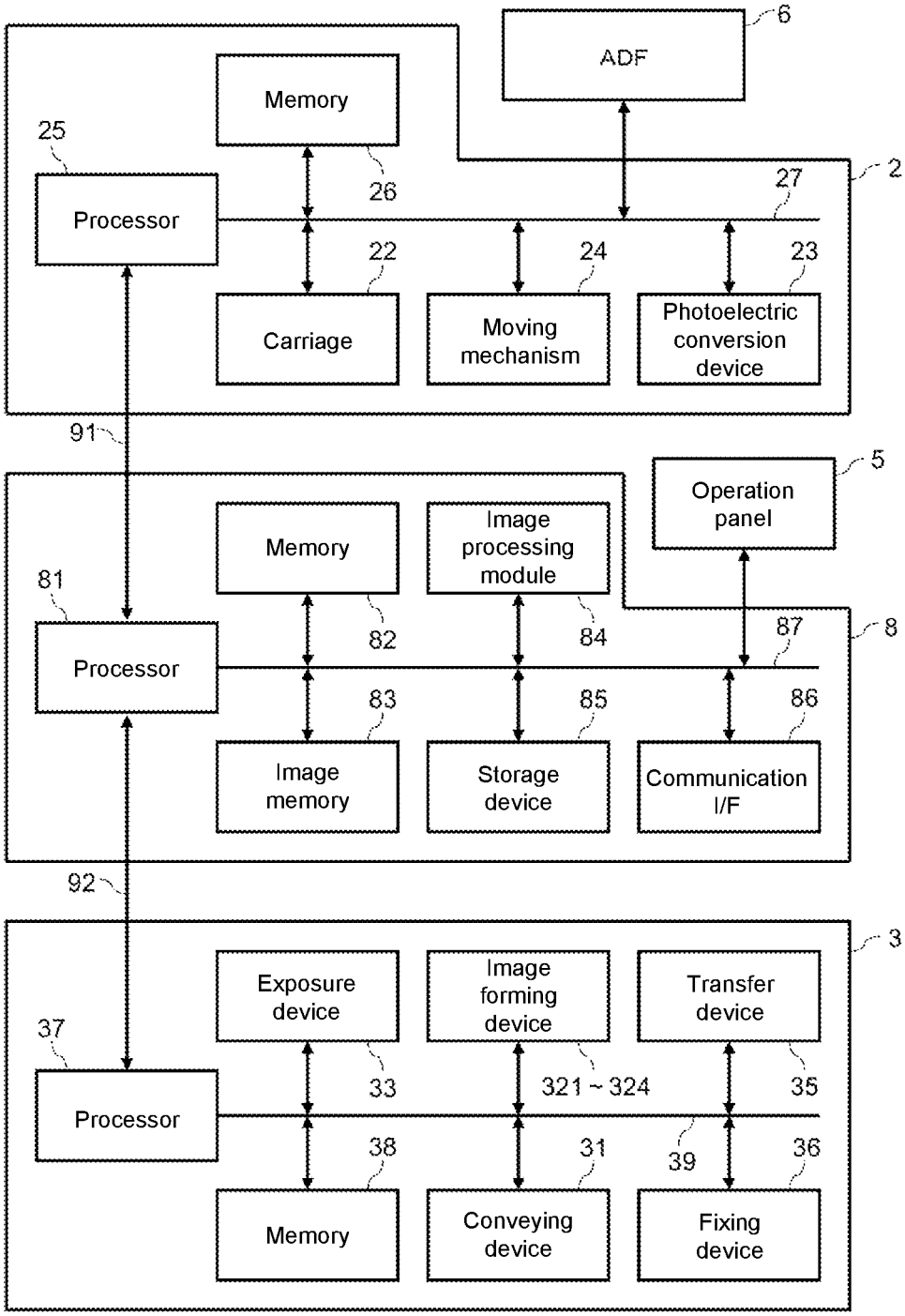
FIG. 5 is a block diagram showing a main circuit configuration of the MFP according to the embodiment.

FIG. 5 is a block diagram showing a main circuit configuration of the MFP 1. The MFP 1 includes a system controller 8. The system controller 8 is connected to the operation panel 5. Further, the system controller 8 controls the scanner device 2 and the printer device 3.

The system controller 8 includes a processor 81, a memory 82, an image memory 83, an image processing module 84, a storage device 85, a communication interface 86, and the like. In the system controller 8, the processor 81 is connected to the memory 82, the image memory 83, the image processing module 84, the storage device 85, the communication interface 86, and the like via a control signal line 87. Further, in the system controller 8, the processor 81 is connected to the operation panel 5 via the control signal line 87.

The processor 81 realizes various processing functions as an MFP by executing the program store in the memory 82 or the storage device 85. For example, the processor 81 executes the program to output an operation instruction to the respective units such as the scanner device 2, the printer device 3, and the ADF 6 and process various types of information from the respective units. Further, the processor 81 executes processing corresponding to the operation input of the touch panel 51 or the operation button 52 of the operation panel 5. Further, the processor 81 controls display on the touch panel 51 of the operation panel 5.

The memory 82 includes a RAM (Random Access Memory), a ROM (Read Only Memory), and the like. The RAM functions as a working memory, a buffer memory, or the like. The ROM functions as a program memory or the like.

The image memory 83 stores image data. For example, the image memory 83 functions a page memory for expanding the image data to be processed. The image processing module 84 processes the image data. The image processing module 84 outputs, for example, image data obtained by performing image processing such as correction, compression, and decompression on the input image data.

The storage device 85 stores data such as control data, a control program, and setting information. The storage device 85 is a rewritable non-volatile memory. As the storage device 85, an HDD (Hard Disk Drive), an SSD (Solid State Drive), or the like is used.

The communication interface 86 is an interface for performing data communication with an external device. For example, the communication interface 86 functions as an image acquisition unit that acquires an image to be printed on paper from an external device such as a PC.

The system controller 8 includes interfaces 91 and 92 with the scanner device 2 and the printer device 3. The processor 81 of the system controller 8 is connected to a processor 25 of the scanner device 2 via the interface 91. The processor 81 of the system controller 8 is connected to a processor 37 of the printer device 3 via the interface 92.

The scanner device 2 includes the processor 25, a memory 26, and the like in addition to the above-mentioned carriage 22, photoelectric conversion device 23, and moving mechanism 24. The processor 25 of the scanner device 2 is connected to the memory 26, the carriage 22, the photoelectric conversion device 23, the moving mechanism 24, and the like via a control signal line 27. Further, the processor 25 of the scanner device 2 is connected to the ADF 6 via the control signal line 27.

The processor 25 realizes various processing functions as the scanner device 2 by executing the program stored in the memory 26. For example, the processor 25 executes scanning processing in accordance with an operation instruction from the system controller 8. Further, the processor 25 controls driving of the ADF 6 in accordance with an operation instruction from the system controller 8.

The memory 26 includes a RAM, a ROM, and the like. The RAM functions as a working memory, a buffer memory, or the like. The ROM function as a program memory or the like.

The printer device 3 includes the processor 37, a memory 38, and the like in addition to the above-mentioned conveying device 31, image forming devices 321, 332, 323, and 324, exposure device 33, transfer device 35, and fixing device 36. The processor 37 of the printer device 3 is connected to the memory 38, the conveying device 31, the image forming devices 321, 322, 323, and 324, the exposure device 33, the transfer device 35, the fixing device 36, and the like via a control signal line 39.

The processor 37 realizes various processing functions as the printer device 3 by executing the program stored in the memory 38. For example, the processor 37 executes printing processing in accordance with an operation instruction from the system controller 8.

The memory 38 includes a RAM, a ROM, and the like. The RAM functions as a working memory, a buffer memory, or the like. The ROM function as a program memory or the like.

[Description of ADF Circuit]

Figure 6:
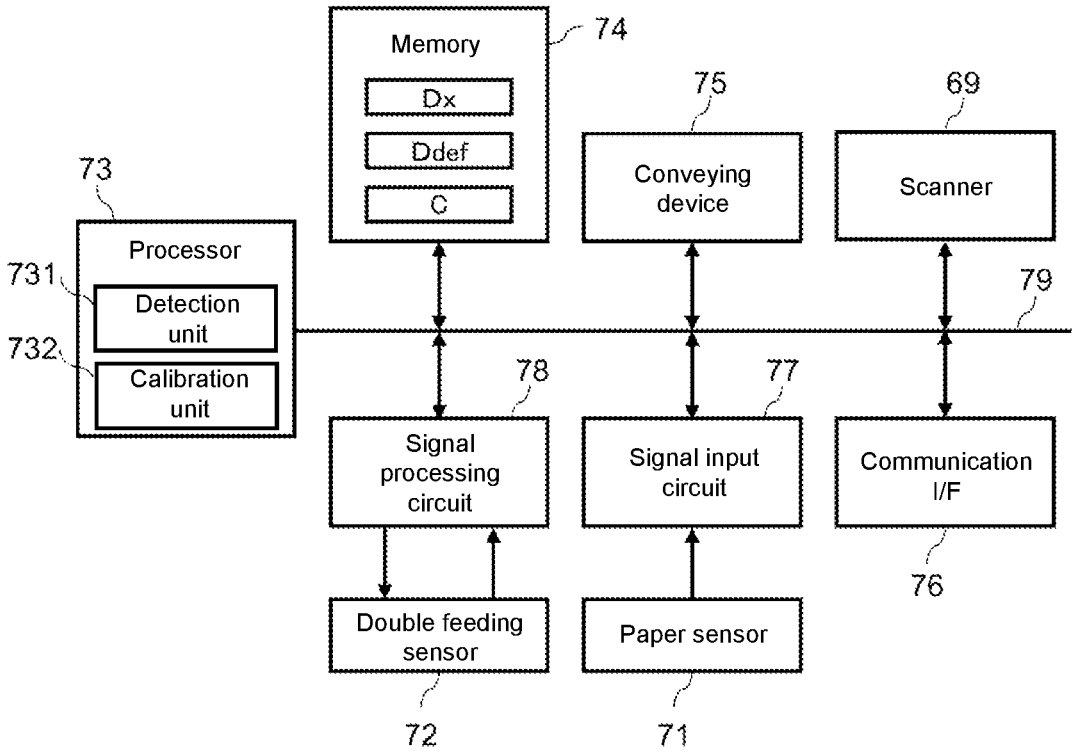
FIG. 6 is a block diagram showing a main circuit configuration of the ADF according to the embodiment.

FIG. 6 is a block diagram showing a main circuit configuration of the ADF 6. The ADF 6 includes a processor 73, a memory 74, a conveying device 75, a communication interface 76, a signal input circuit 77, and a signal processing circuit 78 in addition to the above-mentioned scanner 69. The processor 73 of the ADF 6 is connected to the memory 74, the conveying device 75, the communication interface 76, the signal input circuit 77, the signal processing circuit 78, and the like via a control signal line 79.

The conveying device 75 is a mechanism for conveying the sheet fed from the paper feed unit 62 along the conveying path 65 and discharging the sheet from the paper discharge unit 64. The conveying device 75 includes the plurality of conveying rollers 661, 662, 663, and 664 and the resist roller 67. Further, the conveying device 75 includes a motor for driving each of the conveying rollers 661, 662, 663, and 664 and the resist roller 67. The communication interface 76 functions as an interface with the scanner device 2. The signal input circuit 77 inputs a signal from the paper feed sensor 71. The signal processing circuit 78 processes the signal according to the double feeding sensor 72. Details of the signal processing circuit 78 will be described below with reference to FIG. 7.

The processor 73 controls the respective units in accordance with an operation instruction given from the system controller 8 via the scanner device 2. For example, the processor 73 controls the conveying device 75 to convey a sheet along the conveying path 65. Further, in the case where the system controller 8 has instructed to read a screen, the processor 73 controls the scanner 69 to read the image on the second surface of the sheet. The processor 73 then outputs the image data read by the scanner 69 to the scanner device 2 via the communication interface 76. The scanner device 2 outputs, to the system controller 8 via the interface 91, the image data of the second surface of the sheet received from the ADF 6 together with the image data of the first surface of the sheet read by the scanner device 2.

Figure 7:
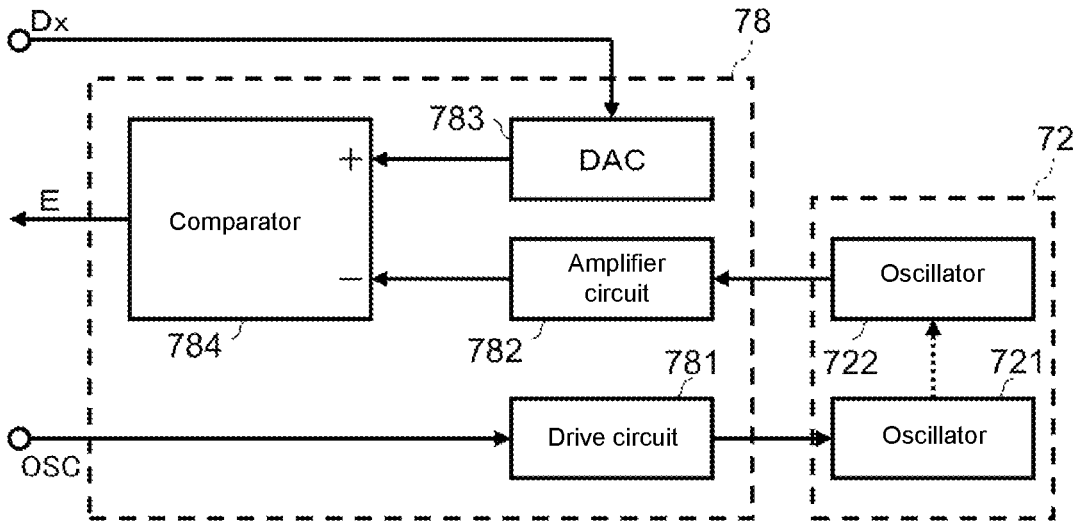
FIG. 7 is a block diagram showing a main circuit configuration of a signal processing circuit and a double feeding sensor shown in FIG. 6.

FIG. 7 is a block diagram showing a main circuit configuration of the signal processing circuit 78 and the double feeding sensor 72. The signal processing circuit 78 includes a drive circuit 781, an amplifier circuit 782, a DAC (Digital Analog Converter) 783, and a comparator 784. The double feeding sensor 72 includes the oscillator 721 and the receiver 722 of ultrasonic waves.

The drive circuit 781 drives the oscillator 721 in accordance with an oscillation signal osc given from the processor 73 of the ADF 6. By this driving, the oscillator 721 oscillates ultrasonic waves. The ultrasonic waves oscillated from the oscillator 721 are received by the receiver 722. The receiver 722 outputs a voltage signal corresponding to the level of the received ultrasonic waves.

The amplifier circuit 782 amplifies the voltage signal output from the receiver 722. The amplifier circuit 782 supplies the amplified voltage signal to an inverting input terminal (−) of the comparator 784.

The digital/analog converter (DAC) 783 converts digital data Dx given from the processor 73 into an analog voltage signal. The DAC 783 supplies the converted voltage signal to a non-inverting input terminal (+) of the comparator 784.

The comparator 784 compares the voltage of the signal input to the inverting input terminal (−), i.e., the inverting input voltage, with the voltage of the signal input to the non-inverting input terminal (+), i.e., the non-inverting input voltage. The comparator 784 then outputs, in the case where the inverting input voltage is lower than the non-inverting input voltage, a binarized signal E of a low level "L". The comparator 784 outputs, in the case where the inverting input voltage is higher than the non-inverting input voltage, the binarized signal E of a high level "H".

As shown in FIG. 6, the processor 73 has a function as a detection unit 731 and a function as a calibration unit 732. The detection unit 731 detects, on the basis of the comparison result of the comparator 784 in the signal processing circuit 78, double feeding of sheets conveyed through the conveying path 65. Specifically, the detection unit 731 determines, in the case where the output value of the binarized signal E output from the comparator 784 is a high level "H", that double feeding has occurred. The detection unit 731 determines, in the case where the output value of the binarized signal E described above is a low level "L", that double feeding has not occurred.

The calibration unit 732 calibrates, on the basis of the offset voltage of the amplifier circuit 782 in the signal processing circuit 78 when the receiver 722 of the double feeding sensor 72 has not received ultrasonic waves, a threshold voltage to be input to the comparator 784. The threshold voltage is a voltage of a signal obtained by analog-converting the digital data Dx given from the processor 73 to the DAC 783. Hereinafter, this threshold voltage will be referred to as the threshold voltage Vx.

The memory 74 of the ADF 6 includes a storage region of the digital data Dx corresponding to the threshold voltage Vx, a storage region of a default data Ddef of the digital data Dx, and a storage region of a counter C in order for the processor 73 to function as the calibration unit 732.

[Description of Detection Unit]

Figure 8:
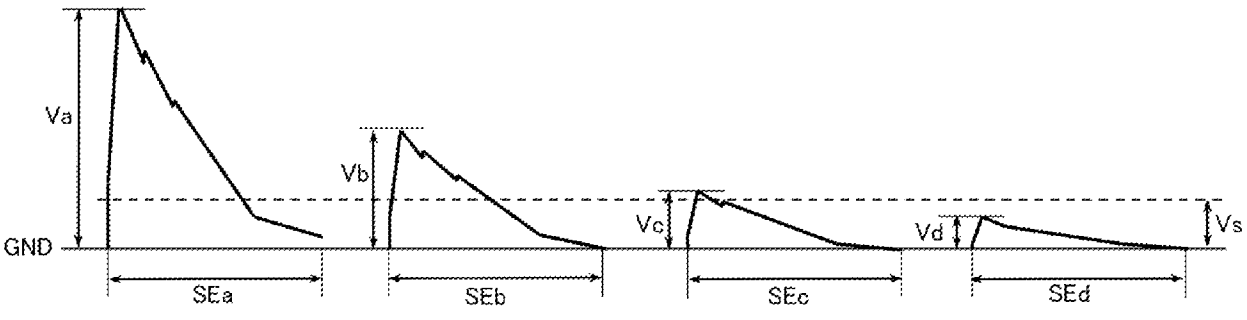
FIG. 8 is an explanatory diagram of a voltage signal to be input to an inverting input terminal of a comparator shown in FIG. 7.

FIG. 8 is an explanatory diagram of a voltage signal to be input to the inverting input terminal (−) of the comparator 784. In FIG. 8, the voltage signal in a section SEa is a voltage signal in the case where the oscillator 721 oscillated ultrasonic waves at the start of the section SEa while a medium such as a sheet is not present between the oscillator 721 and the receiver 722. The voltage signal in a section SEb is a voltage signal in the case where the oscillator 721 oscillated ultrasonic waves at the start of the section SEb while one sheet is present between the oscillator 721 and the receiver 722. The voltage signal in a section Sec is a voltage signal in the case where the oscillator 721 oscillated ultrasonic waves at the start of the section SEc while one sheet having the thickness larger than that in the section SEb is present between the oscillator 721 and the receiver 722. The voltage signal of a section SEd is a voltage signal in the case where the oscillator 721 oscillated ultrasonic waves at the start of the section SEd while two sheets are stacked and present between the oscillator 721 and the receiver 722, the two sheets being the same as that in the section SEb.

In FIG. 8, a voltage Va is a peak voltage of the voltage signal in the section SEa. A voltage Vb is a peak voltage of the voltage signal in the section SEb. A voltage Vc is a peak voltage of the voltage signal in the section SEc. A voltage Vd is a peak voltage of the voltage signal in the section SEd. A voltage Vs is an offset voltage of the amplifier circuit 782. As shown in FIG. 8, the offset voltage Vs and the respective voltages Va, Vb, Vc, Vd, and Ve satisfy the following formula (1).

$$Va>Vb>Vc>Vs>Vd \quad (1)$$

That is, the peak voltage of the voltage signal obtained by amplifying the output signal from the receiver 722 by the amplifier circuit 782 is the highest in the state where a medium such as a sheet is not present between the oscillator 721 and the receiver 722. In the case where a sheet is present between the oscillator 721 and the receiver 722, since ultrasonic waves that reach the receiver 722 are attenuated, the peak voltage decreases. The decrease rate increases as the thickness of the sheet increases. In particular, in the case where double feeding in which two sheets overlap with each other has occurred, ultrasonic waves are attenuated by the air layer between the sheets, the decrease rate becomes larger, and the peak voltage becomes lower than the offset voltage Vs. Incidentally, when the peak voltage is lower than the offset voltage Vs, the offset voltage Vs is input to the inverting input terminal (−) of the comparator 784.

Figure 9:
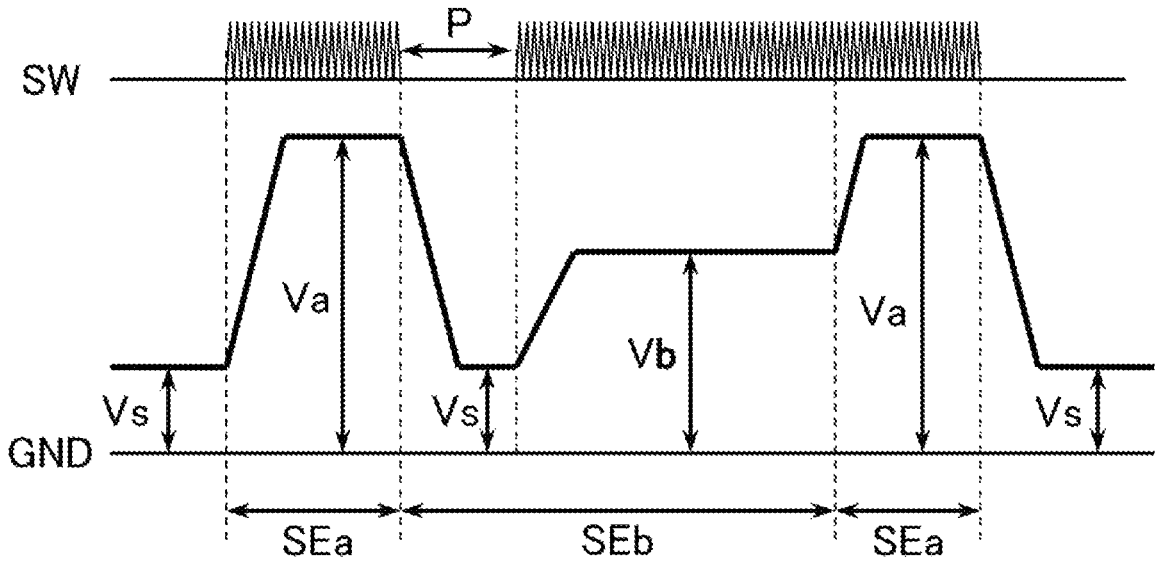
FIG. 9 is a waveform diagram showing the transition of a voltage signal to be input to the inverting input terminal of the comparator shown in FIG. 7.
Figure 10:
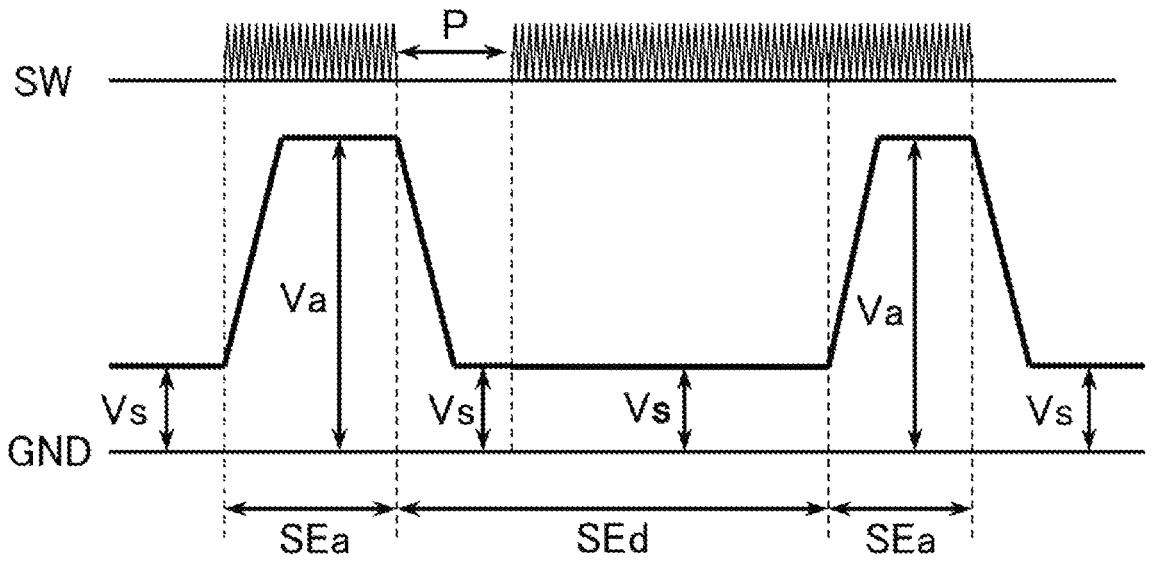
FIG. 10 is a waveform diagram showing the transition of a voltage signal to be input to the inverting input terminal of the comparator shown in FIG. 7.

FIG. 9 and FIG. 10 are each a waveform diagram showing the transition of a voltage signal to be input to the inverting input terminal (−) of the comparator 784. FIG. 9 represents the case where the state has changed from the section Sea in which a medium such as a sheet is not present between the oscillator 721 and the receiver 722 to the section SEb in which one sheet is present, i.e., a normal conveying state, and then has returned to the section SEa in which a medium is not present. FIG. 10 represents the case where the state has changed from the section SEa in which a medium is not present to the section SEd in which two sheets are present, i.e., the state where double feeding has occurred, and then has returned to the section SEa in which a medium is not present.

Note that in FIG. 9 and FIG. 10, a waveform SW represents an ultrasonic signal oscillated from the oscillator 721. When the oscillation signal osc is given from the processor 73 to the drive circuit 781, the oscillator 721 starts oscillating. The processor 73 stops, in the case where the paper feed sensor 71 has detected feeding of a sheet, the oscillation signal osc for a predetermined time period P. When the oscillation signal osc is stopped, the oscillator 721 stops oscillating. When the predetermined time period P has elapsed, the oscillation signal osc is given from the processor 73 to the drive circuit 781 again. As a result, the oscillator 721 resumes oscillation.

As shown in FIG. 9 and FIG. 10, no signal is output from the receiver 722 before entering the section SEa, i.e., while the oscillator 721 is not oscillating. For this reason, the offset voltage Vs of the amplifier circuit 782 is input to the inverting input terminal (−) of the comparator 784. That is, the inverting input voltage is the offset voltage Vs.

When the oscillator 721 starts oscillating in the section SEa, the receiver 722 outputs a signal corresponding to the reception level. As a result, the inverting input voltage is the peak voltage Va in the section SEa in which a medium is not present.

After that, when the paper feed sensor 71 has detected feeding of a sheet and the oscillator 721 stops oscillating in the section SEb or the section SEd, the inverting input voltage is the offset voltage Vs of the amplifier circuit 782. Then, when the predetermined time period P has elapsed and the oscillator 721 resumes oscillation, the level of the inverting input voltage differs between the case of FIG. 9 and the case of FIG. 10. That is, in the section SEb of the normal state where one sheet is conveyed, the inverting input voltage is the peak voltage Vb in the section SEb. In the section SEd of the double feeding state where two sheets overlap with each other and are conveyed, the inverting input voltage is the offset voltage Vs of the amplifier circuit 782.

After that, when the section SEa is reached, in both the cases of FIG. 9 and FIG. 1, the inverting input voltage is the peak voltage Va in the section SEa in which a medium is not present. Then, when the oscillator 721 stops oscillating, the inverting input voltage is the offset voltage Vs of the amplifier circuit 782.

As described with reference to FIG. 8 to FIG. 10, in the case where double feeding of sheets conveyed through the conveying path 65 by the conveying device 75 of the ADF 6 has not occurred, the inverting input voltage is a voltage higher than the offset voltage Vs of the amplifier circuit 782. Meanwhile, in the case where double feeding has occurred, the inverting input voltage is the offset voltage Vs of the amplifier circuit 782. In this regard, the non-inverting input voltage, that is, the threshold voltage Vx is set to a voltage slightly higher than the offset voltage Vs of the amplifier circuit 782. As a result, the output value of the binarized signal E from the comparator 784 is a low level "L" in the case where double feeding has not occurred and a high level "H" in the case where double feeding has occurred. The detection unit 731 detects double feeding in the case where the output value of the binarized signal E of the comparator 784 has changed to the high level "H".

[Description of Calibration Unit]

As described above, by setting the threshold voltage Vx to be input to the non-inverting input terminal (+) of the comparator 784 to a voltage slightly higher than the offset voltage Vs of the amplifier circuit 782, the detection unit 731 is capable of correctly detecting double feeding. Meanwhile, the offset voltage Vs of the amplifier circuit 782 differs depending on the amplifier circuit 782. For this reason, for example, it is necessary to calibrate the threshold voltage Vx to be a voltage slightly higher than the offset voltage Vs of the amplifier circuit 782 before shipping the product. Such calibration processing is realized by the calibration unit 732 of the processor 73.

Figure 11:
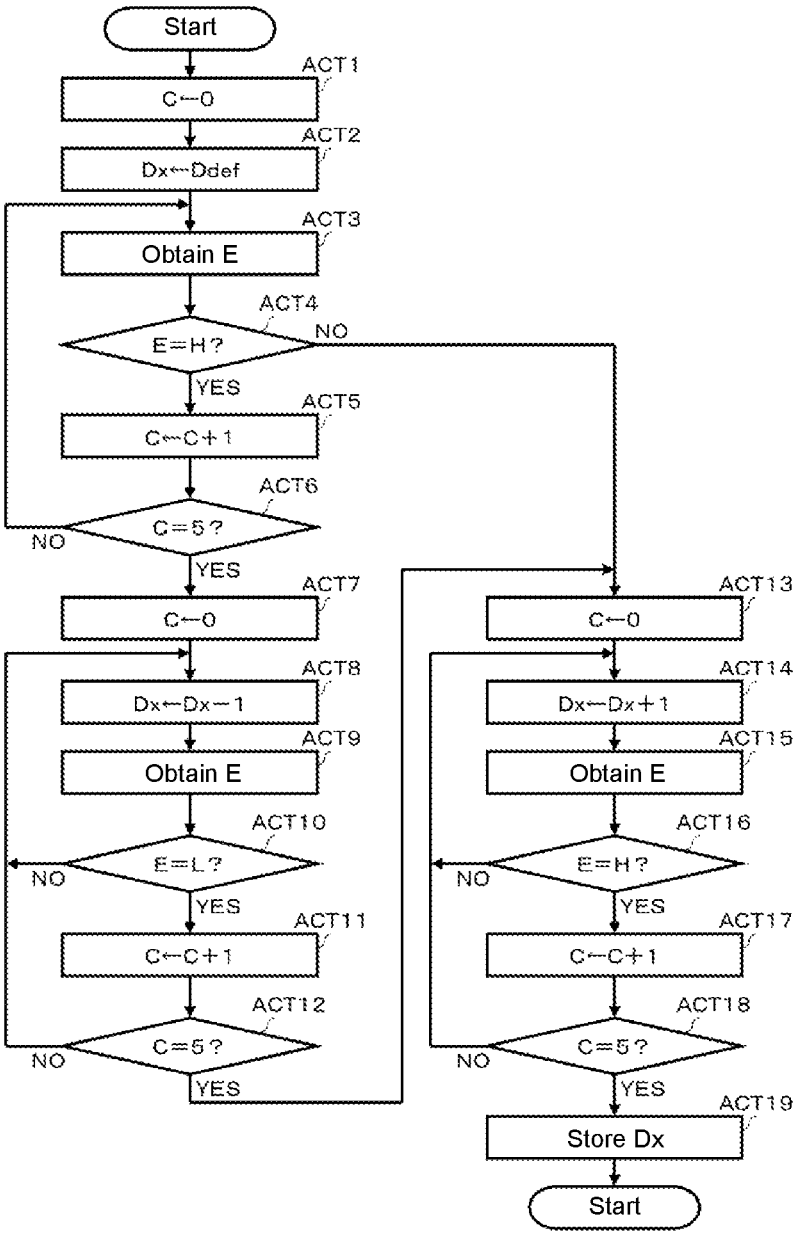
FIG. 11 is a flowchart showing a main procedure of calibration processing realized by a processor shown in FIG. 6 by the function of a calibration unit.

FIG. 11 is a flowchart showing calibration processing realized by the processor 73 by the function of the calibration unit 732. Note that the procedure of the processing described below is an example. The procedure and content thereof are not particularly limited as long as similar operation and effect can be achieved.

For example, a user operates the operation panel 5 to select the calibration mode of the threshold voltage Vx. Then, the processor 81 of the system controller 8 instructs the processor 73 of the ADF 6 to calibrate the threshold voltage Vx via the processor 25 of the scanner device 2. In response to this instruction, the processor 73 starts the processing shown in FIG. 11.

In ACT1, the processor 73 rests the counter C of the memory 74 to "0". In ACT2, the processor 73 sets the digital data Dx to be output to the DAC 783 of the signal processing circuit 78 to the default data Ddef stored in the memory 74. Then, in ACT3, the processor 73 acquires the binarized signal E output from the comparator 784 of the signal processing circuit 78.

At this time, the oscillator 721 of the double feeding sensor 72 does not oscillate ultrasonic waves. For this reason, the offset voltage Vs of the amplifier circuit 782 is input to the inverting input terminal (−) of the comparator 784. Meanwhile, the voltage of the voltage signal obtained by analog-converting the digital data Dx, i.e., the so-called threshold voltage Vx is input to the non-inverting input terminal (+) of the comparator 784. In the case where the threshold voltage Vx is higher than the offset voltage Vs of the amplifier circuit 782, the output value of the binarized signal E is a high level "H". In the case where the threshold voltage Vx is lower than the offset voltage Vs of the amplifier circuit 782, the output value of the binarized signal E is a low level "L". In ACT4, the processor 73 determines whether or not the output value of the binarized signal E is a high level "H".

Now, for example, assumption is made that the voltage (the threshold voltage Vx) of the signal obtained by analog-converting the default data Ddef by the DAC 783 is higher than the offset voltage Vs of the amplifier circuit 782. In this case, the output value of the binarized signal E is a high level "H". In the case where the processor 73 determines that the output value described above of the binarized signal E is a high level "H" (YES in ACT4), the processing of the processor 73 proceeds to ACT5. In ACT5, the processor 73 counts up the counter C by "1".

In ACT6, the processor 73 determines whether or not the counter C has reached a set value "5". In the case where the processor 73 determines that the counter C has not reached the setting value "5" (NO in ACT6), the processing of the processor 73 returns to ACT3. The processor 73 executes the processing of ACT3 and subsequent processing in the same manner as described above.

In the case where the voltage (the threshold voltage Vx) of the signal obtained by analog-converting the default data Ddef by the DAC 783 is higher than the offset voltage Vs of the amplifier circuit 782, the output value of the binarized signal E is maintained at the high level "H". For this reason, the closed loop of ACT3 to ACT6 is repeated, and thus, the counter C reaches the set value "5". In the case where it is determined that the counter C has reached the set value "5" (YES in ACT6), the processing of the processor 73 proceeds to ACT7. In ACT7, the processor 73 resets the counter C to "0". In ACT8, the processor 73 reduces the digital data Dx to be output to the DAC 783 of the signal processing circuit 78 by 1 bit. Then, in ACT9, the processor 73 acquires the binarized signal E.

In ACT10, the processor 73 determines whether or not the output value of the binarized signal E has reached the "L" level. In the case where the threshold voltage Vx is still higher than the offset voltage Vs of the amplifier circuit 782 even after reducing the digital data Dx by 1 bit from the default data Ddef, the output value of the binarized signal E is maintained at the high level "H". In the case where it is determined that the output value of the binarized signal E is not the low level "L", i.e., the output value of the binarized signal E is the high level "H" (NO in ACT10), the processing of the processor 73 returns to ACT8. The processor 73 executes the processing of ACT3 and subsequent processing in the same manner as described above.

In this way, each time the closed loop of ACT8 to ACT10 is repeated, the digital data Dx is reduced by 1 bit. Along with this, the threshold voltage Vx is reduced in a stepwise manner. In the case where the threshold voltage Vx is lower than the offset voltage Vs of the amplifier circuit 782, the output value of the binarized signal E is a low level "L".

In the case where it is determined that the output value of the binarized signal E has reached the low level "L" (YES in ACT10), the processing of the processor 73 proceeds to ACT11. In ACT11, the processor 73 counts up the counter C by "1". Then, in ACT12, the processor 73 determines whether or not the counter C has reached the set value "5". In the case where it is determined that the counter C has not reached the set value "5" (NO in ACT12), the processing of the processor 73 returns to ACT8. The processor 73 executes the processing of ACT8 and subsequent processing in the same manner as described above.

In the closed loop of ACT8 to ACT12, the digital data Dx is reduced by 1 bit at once. For this reason, the threshold voltage Vx does not become higher than the offset voltage Vs of the amplifier circuit 782. That is, since the output value of the binarized signal E is maintained at the low level "L", the counter C is counted up by "1" at once. In the case where it is determined that the counter C has reached the set value "5" (YES in ACT12), the processing of the processor 73 proceeds to ACT13.

In ACT13, the processor 73 resets the counter C to "0". In ACT14, the processor 73 increases the digital data Dx by 1 bit. Then, in ACT15, the processor 73 acquires the binarized signal E. In ACT16, the processor 73 determines whether or not the binarized signal E has reached the high level "H".

By increasing the digital data Dx, the threshold voltage Vx increases. However, in the case where the threshold voltage Vx is still lower than the offset voltage Vs of the amplifier circuit 782, the output value of the binarized signal E is maintained at the low level "L". In the case where it is determined that the output value of the binarized signal E has not reached the high level "H", i.e., the output value of the binarized signal E is maintained at the low level "L" (NO in ACT16), the processing of the processor 73 returns to ACT14. The processor 73 executes the processing of ACT14 and subsequent processing in the same manner as described above.

Thus, the processor 73 repeats the closed loop of ACT14 to ACT16 until the threshold voltage Vx exceeds the offset voltage Vs of the amplifier circuit 782. That is, the processor 73 increases the digital data Dx by 1 bit at once. As a result, in the case where the threshold voltage Vx exceeds the offset voltage Vs of the amplifier circuit 782, the output value of the binarized signal E reaches the high level "H".

In the case where it is determined that the output value of the binarized signal E has reached the high-level (YES in ACT16), the processing of the processor 73 proceeds to ACT17. In ACT17, the processor 73 counts up the counter C by 1 bit. In ACT18, the processor 73 determines whether or not the counter C has reached the set value "5". In the case where it is determined that the counter C has not reached the set value "5" (NO in ACT18), the processing of the processor 73 returns to ACT14. The processor 73 executes the processing of ACT14 and subsequent processing in the same manner as described above.

In the closed loop of ACT14 to ACT18, the digital data Dx increases by 1 bit at once. For this reason, the threshold voltage Vx does not become lower than the offset voltage Vs of the amplifier circuit 782. That is, since the output value of the binarized signal E is maintained at the high level "H", the counter C is counted up by "1" at once. In the case where it is determined that the counter C has reached the set value "5" (YES in ACT18), the processing of the processor 73 proceeds to ACT19.

In ACT19, the processor 73 stores the current digital data Dx in the digital-data-Dx storage region of the memory 74. In this way, the processor 73 ends the calibration processing by the function of the calibration unit 732.

As described above, in the case where the voltage (the threshold voltage Vx) of the signal obtained by analog-converting the default data Ddef of the digital data Dx by the DAC 783 is larger than the offset voltage Vs of the amplifier circuit 782 (YES in ACT4), the processor 73 executes the processing of ACT3 to ACT19 to set the digital data Dx for determining the threshold voltage Vx.

Note that in the case where the voltage (the threshold voltage Vx) of the signal obtained by analog-converting the default data Ddef of the digital data Dx by the DAC 783 is larger than the offset voltage Vs of the amplifier circuit 782, the processor 73 determines that the output value of the binarized signal E is not the high level "H", i.e., the output value is the low level "L". The processor 73 skips the processing of ACT5 to ACT12 and the processing proceeds to ACT13. The processor 73 then executes the processing of ACT13 and subsequent processing in the same manner as described above. That is, the processor 73 increases the digital data Dx by 1 bit at once from the default data Ddef. In the case where the output value of the binarized signal E reaches the high level "H", the digital data Dx is increased by 1 bit at once until the counter C counts the set value "5". In the case where the counter C has reached the set value "5", the digital data Dx at this time is stored in the digital-data-Dx storage region of the memory 74.

Figure 12:
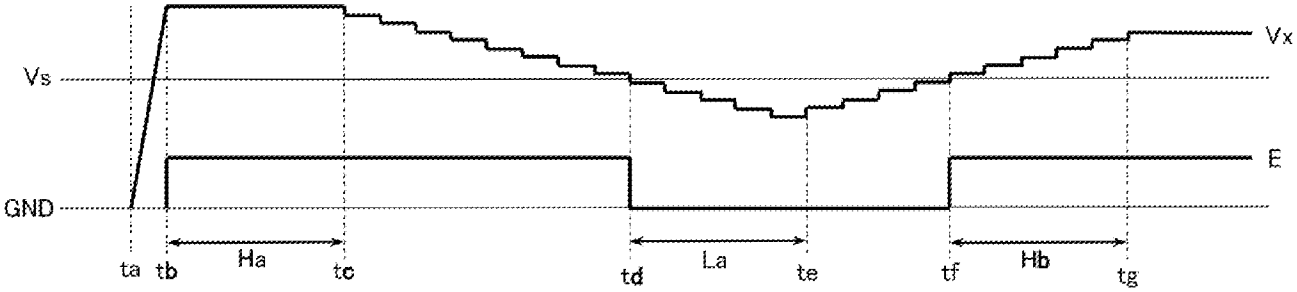
FIG. 12 is a waveform diagram of a threshold voltage and a binarized signal that have transitioned by the calibration processing shown in FIG. 11.

FIG. 12 is a waveform diagram of the threshold voltage Vx and the binarized signal E that have transitioned by the calibration processing described above. In FIG. 12, the voltage Vs is an offset voltage of the amplifier circuit 782. The voltage GND is a ground potential.

A time point to corresponds to the time point in ACT2. When the digital data Dx of the default data Ddef is supplied to the DAC 783, the threshold voltage Vx obtained by analog converting the digital data Dx rises to a value higher than the offset voltage Vs of the amplifier circuit 782. Then, at a time point tb, the binarized signal E of the high level "H" is output from the comparator 784. As a result, the processor 73 repeats the closed loop of ACT3 to ACT6.

A section Ha between the time point tb to a time point tc corresponds to the section of the closed loop of ACT3 to ACT6. The time point tc is a time point when it is determined as YES in ACT6, i.e., a time point when the counter C reached the set value "5". After the time point Tc, the digital data Dx is reduced by 1 bit at once from the default data Ddef. For this reason, the threshold voltage Vx is reduced in a stepwise manner. Then, at a time point td, the threshold voltage Vx becomes lower than the offset voltage Vs of the amplifier circuit 782. As a result, the output value of the binarized signal E is the low level "L".

A section La between the time point td to a time point te corresponds to the section of the closed loop of ACT8 to ACT12. That is, in this section La, the digital data Dx is further reduced by 1 bit at once. For this reason, also the threshold voltage Vx is further reduced.

The time point te is a time point when it is determined as YES in ACT12, i.e., a time point when the counter C reached the set value "5". After the time point te, the digital data Dx increases by 1 bit at once. For this reason, the threshold voltage Vx increases in a stepwise manner. Then, at a time point tf, the threshold voltage Vx becomes higher than the offset voltage Vs of the amplifier circuit 782. As a result, the output value of the binarized signal E is the high level "H".

A section Hb between the time point tf and a time point tg corresponds to the section of the closed loop of ACT14 to ACT18. That is, in this section Hb, the digital data Dx further increases by 1 bit at once. For this reason, also the threshold voltage Vx further increases.

The time point tg is a time point when it is determined as YES in ACT18, i.e., a time point when the counter C reached the set value "5". The digital data Dx at that time is stored in the memory 74. That is, the threshold voltage Vx is a voltage having a value, as the digital data Dx, 5 bits larger than the offset voltage Vs of the amplifier circuit 782.

As described above, the calibration unit 732 of the processor 73 calibrates the threshold voltage Vx on the basis of the offset voltage Vs of the amplifier circuit 782 when the receiver 722 has not received ultrasonic waves. For this reason, since the threshold voltage Vx can be calibrated without oscillating ultrasonic waves from the oscillator 721, it is possible to efficiently calibrate the threshold voltage Vx. Further, it is unnecessary to prepare a sheet for calibration. Therefore, the calibration work is simple.

Further, the calibration unit 732 of the processor 73 calibrates the threshold voltage Vx by the output level of the binarized signal E obtained by comparing the offset voltage Vs of the amplifier circuit 782 input to one input terminal of the comparator 784 with the threshold voltage Vx input to the other input terminal of the comparator 784. Therefore, since the threshold voltage Vx can be calibrated by the processing of the binarized signal E, it is possible to automate the calibration processing as information processing by the processor 73.

Further, the calibration unit 732 of the processor 73 increases the threshold voltage Vx from a voltage lower than the offset voltage Vs of the amplifier circuit 782 and sets the voltage exceeding the offset voltage Vs as the threshold voltage Vx. Therefore, even in the case where the offset voltage Vs of the amplifier circuit 782 differs for each ADF 6, it is possible to reliably set a desired voltage higher than the offset voltage Vs as the threshold voltage Vx.

Further, the calibration unit 732 of the processor 73 uses a voltage higher than the offset voltage Vs of the amplifier circuit 782 as an initial value at the time of threshold voltage calibration, reduces the threshold voltage Vx from the threshold voltage to be lower than the offset voltage Vs, and then increases the threshold voltage Vx in a stepwise manner, thereby calibrating the threshold voltage Vx. Therefore, it is possible to more reliably set a desired voltage higher than the offset voltage Vs as the threshold voltage Vx.

In particular, the ADF 6 includes the counter C that counts the number of times the same value is repeated after the output value of the binarized signal E of the comparator 784 is inverted. Then, the calibration unit 732 of the processor 73 increases the threshold voltage Vx in a stepwise manner, and sets, as the threshold voltage Vx, the voltage when the counter C counted a predetermined value. Therefore, by setting a predetermined value with respect to the counter C to an appropriate value, it is possible to easily determine how high from the offset voltage Vs the voltage is used as the threshold voltage Vx.

Although an embodiment of a sheet conveying device has been described, the embodiment is not limited thereto.

In the embodiment described above, the set value compared with the counter C was "5". The set value is not limited to "5". The set value only needs to be an arbitrary value of 1 or more.

In the embodiment described above, the case where the digital data Dx is changed by 1 bit at once in ACT8 and ACT14 in FIG. 11 has been illustrated. In another embodiment, the digital data Dx may be changed by 2 bits at once. Alternatively, a binary search technology may be used to determine the digital data Dx by which an appropriate threshold voltage Vx can be obtained.

In the embodiment described above, the calibration work has been described as being performed before shipping the product. The calibration work may be regularly or irregularly performed as part of maintenance after shipping the product.

In the embodiment described above, the ADF 6 has been described as a device for feeding paper to scan both sides of a document at the same time, i.e., a so-called DSDF. The ADF 6 may be a device for feeding paper to scan one side of a document.

Further, the sheet conveying device is not limited to the ADF 6 of the MFP 1. The sheet conveying device may be a sheet conveying device applied to a printer, a copying machine, a facsimile machine, or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet conveying device, comprising:

a conveying device that conveys a sheet through a conveying path;

an oscillator that oscillates ultrasonic waves on the sheet conveyed through the conveying path;

a receiver that is provided at a position facing the oscillator across the conveying path and receives the ultrasonic waves oscillated from the oscillator;

an amplifier circuit that amplifies an output signal of the receiver;

a comparator that compares a voltage of the output signal amplified by the amplifier circuit with a threshold voltage; and a processor configured to detect, on a basis of a comparison result of the comparator, double feeding of sheets conveyed through the conveying path, and calibrate the threshold voltage on a basis of an offset voltage of the amplifier circuit where the receiver has not received the ultrasonic waves, wherein the processor calibrates the threshold voltage by a binarized output value obtained by comparing the offset voltage of the amplifier circuit, which is input to a first input terminal of the comparator, with the threshold voltage, which is input to a second input terminal of the comparator.

2. The sheet conveying device according to claim 1, wherein the processor inputs the threshold voltage to the comparator, increases, where the threshold voltage that is input to the comparator is lower than the offset voltage of the amplifier circuit, an input voltage from a voltage lower than the offset voltage in a stepwise manner, and sets, as the threshold voltage, the input voltage when exceeding the offset voltage.

3. The sheet conveying device according to claim 2, further comprising a memory that stores data of the threshold voltage, wherein the processor determines whether a threshold voltage based on the threshold voltage stored in the memory is higher or lower than the offset voltage of the amplifier circuit.

4. The sheet conveying device according to claim 3, wherein the processor inputs, to the comparator, a threshold voltage based on data of the threshold voltage stored in the memory, and determines, on a basis of the binarized output value of the comparator, whether the threshold voltage based on the data of the threshold voltage stored in the memory is higher or lower than the offset voltage of the amplifier circuit.

5. The sheet conveying device according to claim 2, wherein the processor inputs, to the comparator, a threshold voltage based on data of the threshold voltage stored in the memory, increases, where the threshold voltage is lower than the offset voltage of the amplifier circuit, the input voltage to the comparator in a stepwise manner, and stores, in the memory, data of the input voltage when exceeding the offset voltage as the data of the threshold voltage.

6. The sheet conveying device according to claim 3, wherein the processor inputs, to the comparator, a threshold voltage based on data of the threshold voltage stored in the memory, increases, where the threshold voltage is lower than the offset voltage of the amplifier circuit, the input voltage to the comparator in a stepwise manner, and stores, in the memory, data of the input voltage when the binary output value of the comparator is inverted as the data of the threshold voltage.

7. The sheet conveying device according to claim 2, wherein the processor calibrates the threshold voltage by inputting, to the comparator, a voltage higher than the offset voltage of the amplifier circuit as an initial value at the time of the calibration of the threshold voltage, reducing the threshold voltage of the initial value from the voltage of the initial value, increasing the offset voltage in a stepwise manner after exceeding the offset voltage, and setting, as the threshold voltage, the input voltage of the comparator when exceeding the offset voltage.

8. The sheet conveying device according to claim 7, wherein the processor calibrates the threshold voltage by reducing the threshold voltage of the initial value from the voltage of the initial value, increasing the offset voltage in a stepwise manner after the binarized output value of the comparator is inverted, and setting, as the threshold voltage, the input voltage of the comparator when the binarized output value of the comparator is inverted again.

9. The sheet conveying device according to claim 7, further comprising a counter that counts the number of times a same value is repeated after the binarized output value of the comparator is inverted, wherein the processor increases the threshold voltage in a stepwise manner, and sets, as the threshold voltage, the voltage when the counter has counted a predetermined value.

* * * * *